United States Patent [19]

Bretl et al.

[11] Patent Number: 4,755,914

[45] Date of Patent: Jul. 5, 1988

[54] HUNTING BOW LIGHT SIGHT

[76] Inventors: Norbert R. Bretl, 527 Maple Bluff Rd., Stevens Point, Wis. 54481; Dennis P. Domask, Rte. 2, Box 117D, Iola, Wis. 54945

[21] Appl. No.: 89,778

[22] Filed: Aug. 27, 1987

[51] Int. Cl.[4] ..... F21V 33/00

[52] U.S. Cl. ..... 362/109; 362/110

[58] Field of Search ..... 362/109, 110, 111, 112, 362/113, 114, 800, 280; 33/265, 241

[56] References Cited

U.S. PATENT DOCUMENTS

| | | | |
|---|---|---|---|
| 2,447,892 | 8/1948 | Baliff . | |
| 2,995,834 | 8/1961 | Bowe | 362/111 |
| 3,106,348 | 10/1965 | Robinson | 362/110 |
| 4,170,071 | 10/1979 | Mann et al. . | |
| 4,195,414 | 4/1980 | Robinson . | |
| 4,220,983 | 9/1980 | Schroeder | 362/114 |
| 4,291,469 | 8/1981 | Weast . | |
| 4,296,725 | 10/1981 | Broderick . | |
| 4,348,716 | 9/1982 | Storm et al. | 362/110 |
| 4,488,369 | 12/1984 | Van Nole | 362/110 |
| 4,521,972 | 6/1985 | Larson | 362/110 |
| 4,533,980 | 8/1985 | Hayes | 362/110 |
| 4,542,447 | 8/1985 | Quakenbush . | |
| 4,574,335 | 3/1986 | Frimer | 362/110 |

*Primary Examiner*—Samuel Scott
*Assistant Examiner*—Noah Kamen
*Attorney, Agent, or Firm*—Fleit, Jacobson, Cohn & Price

[57] ABSTRACT

A mount is provided for stationary support from an apparatus such as a hunting bow or gun to be directionally aimed and with the mount including a forwardly facing portion facing substantially in the direction in which the apparatus is to be aimed and defining a center axis substantially paralleling the aforementioned direction. A support is mounted from the mount for adjusted angular displacement about the center axis and limited omniangular deflection relative to the center axis. A light beam generating mechanism is stationarily mounted from the support in position thereon for casting a light beam along a path extending, generally, in the direction in which the apparatus is to be aimed.

5 Claims, 1 Drawing Sheet

12
10
16
14
18
20
22
24
26
28
30
32
34
36
38
40
42
44
46
48
50
52
54
56
58
60
62
64
66
68
70
72
74
76
2
3

HUNTING BOW LIGHT SIGHT

BACKGROUND OF THE INVENTION

1. Field of the Invention

This invention relates to a support and mounting structure for mounting the support from a longitudinal center portion of a hunting bow for adjusted angular displacement relative to the bow about a center axis and limited omniangular deflection relative to the center axis. A light beam generating mechanism is stationarily mounted from the support in position thereon for casting a light beam along a path generally centered with the aforementioned axis and extending forwardly of the hunting bow longitudinal mid-portion.

2. Description of Related Art

Various different forms of adjustable sight mounts, camera mounts, and lighting attachments heretofore have been provided for firearms and hunting bows. Examples of these previously known forms of attachments including some of the general structural and operational features of the instant invention are disclosed in U.S. Pat. Nos. 2,447,892; 4,170,071; 4,195,414; 4,291,469; 4,296,725; and 4,542,447. However, these previously known forms of attachments do not include the novel mounting and adjustability features of the instant invention.

SUMMARY OF THE INVENTION

The present invention incorporates a mount from which a narrow light beam generating mechanism may be stationarily supported for casting a narrow light beam along a predetermined path relative to the mount. Support structure is provided for stationary support from a hunting bow or gun and the mount is supported from the support structure for adjusted angular displacement relative thereto about a center axis generally coinciding with the aforementioned path and limited omniangular deflection relative to the center axis. The main object of this invention is to provide spot-type illumination means for casting a narrow beam of light substantially along the line of sight of a hunting bow or gun.

Another object of this invention is to provide novel mounting structure for the illumination means whereby the beam of light cast thereby may be adjustably angularly deflected relative to the line of sight.

Still another important object of this invention is to provide mounting structure in accordance with the immediately preceding object and whereby the illumination means, adjusted for angular deflection relative to the line of sight, may be rotated about a center axis substantially coinciding with the line of sight.

Yet another object of this invention is to provide illumination means in accordance with the preceding objects and which may be readily mounted from a hunting bow or gun.

A final object of this invention to be specifically enumerated herein is to provide a sighting light for a hunting bow or gun in accordance with the preceding objects and which will conform to conventional forms of manufacture, be of simple construction, and easy to use so as to provide a device that will be economically feasible, long-lasting, and relatively trouble-free in operation.

These, together with other objects and advantages which will become subsequently apparent, reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1, 2, 3:
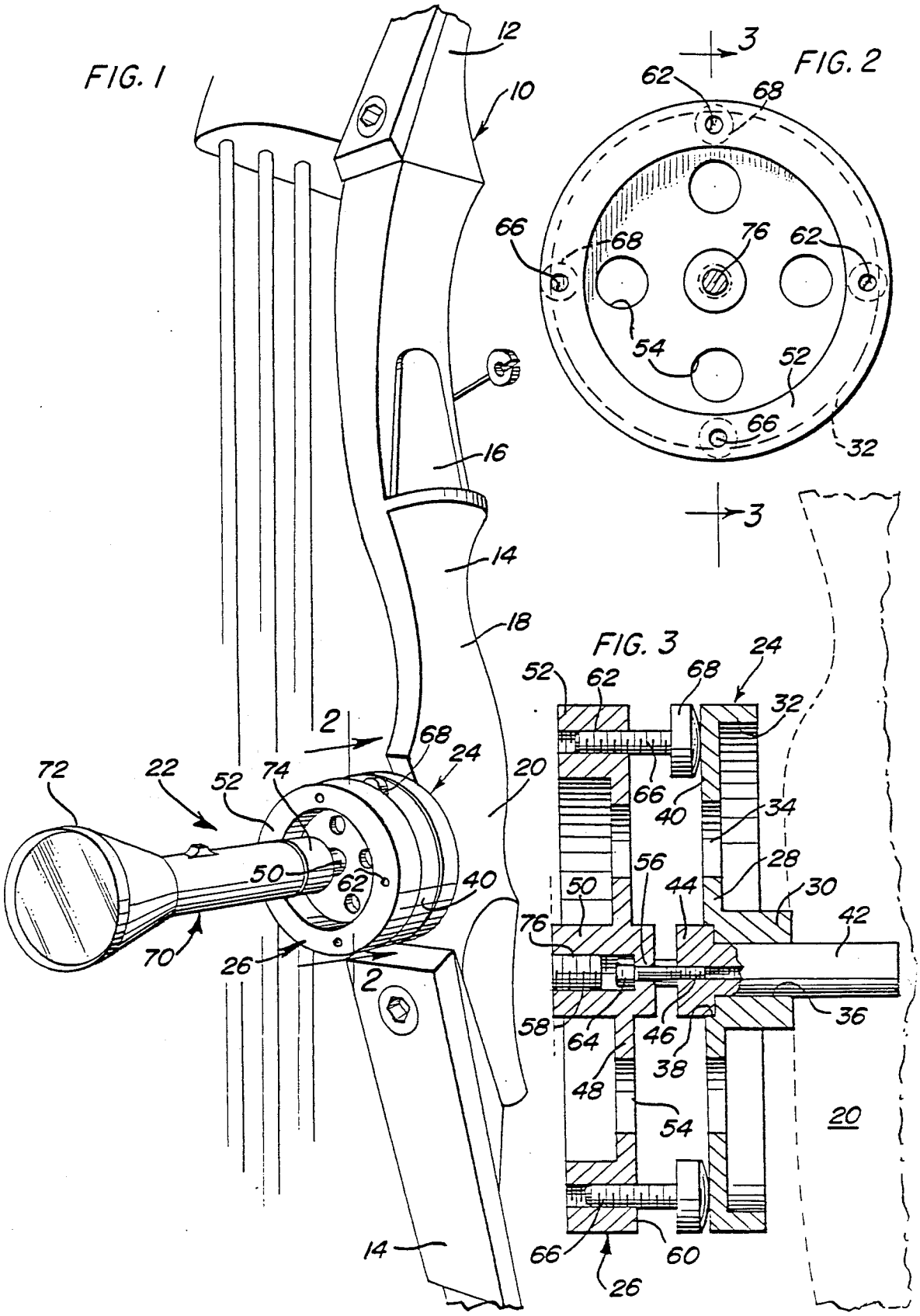
FIG. 1 is a fragmentary front perspective view of a compound bow with the light sight of the instant invention operatively associated with a lower portion of the grip area of the bow.
FIG. 2 is an enlarged vertical sectional view taken substantially upon the plane indicated by the section line 2—2 of FIG. 1.
FIG. 3 is a further enlarged vertical sectional view taken substantially upon the plane indicated by the section line 3—3 of FIG. 2.

Referring now more specifically to the drawings, the numeral 10 generally designates a conventional form of compound bow including a pair of opposite end arms 12 and 14 interconnected by an elongated central or handgrip portion 14. The portion 14 includes an arrow rest area 16, a grip area 18, and an area 20 disposed beneath the grip area.

The light sight of the instant invention is referred to in general by the reference numeral 22 and incorporates a mount referred to in general by the reference numeral 24 and a support 26.

The mount 24 includes a disc-shaped body 28 including a central hub portion 30 and a rearwardly axially projecting circumferential rim 32. The body 28 includes openings 34 formed therein at points spaced equally about and radially outward from the hub portion 30, and the hub portion 30 includes a central bore 36 including an enlarged counterbore 38 on the end thereof opening through the front side of the mount 24.

A headed mounting shank 42 is snugly received through the bore 36, with its head 44 seated in the counterbore 38 and functions to mount the mount 24 from the area 20. The head end of the mounting shank 42 includes a forwardly opening central threaded bore 46 formed therein, and the support 26 also incorporates a disc-shaped body 48 having a central hub portion 50 and an outer circumferential forwardly axially projecting rim 52. The body 48 includes openings 54 formed therein spaced equally about and radially outward from the hub portion 50, and the hub portion 50 includes a bore 56 formed therethrough including a forward counterbore 58. The body 48 includes a rear side 50 spaced from and opposing the front side 40, and the rim 52 includes four equally circumferentially spaced threaded bores 62 formed therethrough.

A headed and threaded mounting shank 64 has the head portion thereof rotatably seated in the counterbore 58, and the shank projects through the bore 56 and is threadingly secured in the bore 46. In addition, threaded shanks 66 are threadedly engaged in the bores 62 and project rearward of the rear side 60 and include enlarged feet 68 on the rear ends thereof engaged with and slidable over the front side 40 of the body 28. Finally, a flashlight or other narrow light beam generating mechanism is generally referred to by the reference numeral 70 and includes a forward light beam emitting end 72 and a rear base end 74, equipped with a rearwardly and outwardly projecting threaded mounting stud 76 tightly threadedly engaged within the counterbore 58.

From the foregoing, it may be seem that the light-generating mechanism or flashlight 70 is supported in stationary position relative to the support 26 and that the threaded shanks 66 and mounting shank 64 comprise mounting structure mounting the support 26 from the mount 24.

The mounting shank 42 is initially mounted from the area 20 to extend generally along a path corresponding to the line of sight of the bow 10. After mounting the mounting shank 42 and the mount 24, the support 26 is mounted on mounting shank 42 through utilization of the mounting shank 64, and the base end of the flashlight 70 may have the shank 76 supported therefrom threadedly engaged in the counterbore 58. Thereafter, the shanks 66 are adjustably rotated to properly angularly deflect the flashlight 70 in order to adjust the beam of light to be generated thereby, according to the area of impact of an arrow released from the bow 10 by a given archer.

If it is desired, the flashlight 70 may be adjusted through adjustment of the shanks 66 in a slightly forwardly and upwardly inclined adjusted position so that the beam of light generated thereby will be a little high in relation to the impact area of an arrow.

In addition, if the flashlight 70 is adjusted as discussed above, slight variations for left and right windage may be readily made, as required, by rotating the support 26 between an eighth-turn and a quarter-turn from the originally adjusted position thereof.

The feet 68 include rounded surfaces opposing the plane from surface 40 of the body 28, and, accordingly, even though the mounting shank 64 may be reasonably tight, the support 26 may be angularly displaced about the mounting shank 64 relative to the mount 24.

It is further thought that the mounting shank 64 may bottom in the bore 46 when fully tightened. In this manner, the mounting shank 64 will not be loosened upon rotation of the support 26 relative to the mount 24, and the effective axial tension on the mounting shank 64 securing support 26 to the mount 24 may be varied by adjustment of the shanks 66.

The foregoing is considered as illustrative only of the principles of the invention. Further, since numerous modifications and changes will readily occur to those skilled in the art, it is not desired to limit the invention to the exact construction and operation shown and described; and, accordingly, all suitable modifications and equivalents may be resorted to, falling within the scope of the invention.

What is claimed as new is as follows:

1. In combination with an apparatus such as a hunting bow or gun to be directionally aimed, an adjustable aim spot illumination device, said device including a mount stationarily supported from said apparatus and including a forward portion facing in a direction, relative to said apparatus, in which said apparatus is to be aimed, a support, mounting means mounting said support from said mount for providing selective limited omniangular deflection about a single point on a center axis extending generally in said direction and maintaining said omniangular deflection of said support relative to said center axis, and a light beam generating mechanism stationarily mounted from said support in position thereon for casting a light beam along a path generally centered with said axis adjacent said apparatus and extending forwardly of said forward portion.

2. The apparatus of claim 1, wherein said mounting means mounts said support from said mount forward of said forward portion and in substantially front-to-rear alignment therewith.

3. The apparatus of claim 1, wherein said apparatus comprises a bow.

4. In combination with an apparatus such as a hunting bow or gun to be directionally aimed, an adjustable aim spot illumination device, said device including a mount supported from said apparatus and including a forward portion facing in a direction, relative to said apparatus, in which said apparatus is to be aimed, support means, mounting means mounting said support from said mount for limited omniangular deflection relative to a center axis stationary with said mount, and a light beam generating mechanism stationarily mounted from said support in position thereon for casting a light beam along a path generally centered with said axis adjacent said apparatus and extending forwardly from said mount, said mount including a generally circular disc-shaped body generally centered relative to said center axis and disposed normal thereto, said body including an annular, forwardly facing surface area generally centered relative to said axis, said support including a generally circular disc-shaped body spaced forward of the first mentioned body, said mounting means including central fastening means secured centrally through said bodies and mounting the second mentioned body from the first mentioned body for limited omniangular adjustment relative to said center axis and peripherally spaced, threadedly adjustable foot portions threadedly mounted from the second mentioned body and projecting rearwardly therefrom and including head portions engaged with and slidable over said annular surface area, said light beam generating mechanism being stationarily removably mounted from said support in said position thereon.

5. The apparatus of claim 4, wherein said central fastening means also includes means mounting said second mentioned body from said first mentioned body for adjusted angular displacement about said center axis.

* * * * *